US008568116B2

(12) United States Patent
Miyazawa

(10) Patent No.: US 8,568,116 B2
(45) Date of Patent: Oct. 29, 2013

(54) COMPRESSOR HAVING A U-SHAPED DISCHARGE HOLE AND A U-SHAPED DISCHARGE VALVE

(75) Inventor: Kanetaka Miyazawa, Takasaki (JP)

(73) Assignee: Sanden Corporation, Gumma (JP)

( * ) Notice: Subject to any disclaimer, the term of this patent is extended or adjusted under 35 U.S.C. 154(b) by 383 days.

(21) Appl. No.: 12/999,889

(22) PCT Filed: Jun. 2, 2009

(86) PCT No.: PCT/JP2009/060037
§ 371 (c)(1),
(2), (4) Date: Dec. 17, 2010

(87) PCT Pub. No.: WO2009/154076
PCT Pub. Date: Dec. 23, 2009

(65) Prior Publication Data

US 2011/0097230 A1 Apr. 28, 2011

(30) Foreign Application Priority Data

Jun. 17, 2008 (JP) ..... 2008-157525

(51) Int. Cl.
*F04B 39/10* (2006.01)

(52) U.S. Cl.
USPC ..... 417/571; 137/855; 137/856

(58) Field of Classification Search
USPC ..... 417/269, 559–571; 137/855–858
See application file for complete search history.

(56) References Cited

U.S. PATENT DOCUMENTS

| | | | | | |
|---|---|---|---|---|---|
| 3,458,114 | A * | 7/1969 | Catterson | ..... | 417/271 |
| 3,472,446 | A * | 10/1969 | Linnert | ..... | 417/539 |
| 4,628,963 | A * | 12/1986 | Ishijima et al. | ..... | 137/857 |
| 5,147,190 | A * | 9/1992 | Hovarter | ..... | 417/571 |
| 5,226,796 | A * | 7/1993 | Okamoto et al. | ..... | 417/571 |
| 7,390,176 | B2 * | 6/2008 | MacBain et al. | ..... | 417/571 |

FOREIGN PATENT DOCUMENTS

| | | |
|---|---|---|
| JP | 77804/1975 | 7/1975 |
| JP | 43685/1984 | 3/1984 |
| JP | 10-141222 | 5/1998 |
| JP | 11-280685 | 10/1999 |
| JP | 2000-515606 | 11/2000 |
| JP | 2001-221161 | 8/2001 |
| JP | 2005-36694 | 2/2005 |
| JP | 2005-090495 | 4/2005 |
| JP | 2007-518928 | 7/2007 |
| JP | 2009-91932 | 4/2009 |

* cited by examiner

*Primary Examiner* — Peter J Bertheaud
*Assistant Examiner* — Dnyanesh Kasture
(74) *Attorney, Agent, or Firm* — Cozen O'Connor

(57) ABSTRACT

A compressor wherein a valve plate formed with a suction hole and a discharge hole is interposed between a cylinder head and a cylinder block and a discharge valve formed as a reed valve is provided relative to the discharge hole on the valve plate. The discharge hole is formed in a U-shape having a bottom part located at the tip side of the reed valve, and the reed valve is formed as a U-shape extending in correspondence to the U-shape of the discharge hole. The cross-sectional area of flow of discharge gas can be significantly increased to drastically reduce flow path resistance, and excessive compression may be suppressed to greatly improve the efficiency of the compressor.

15 Claims, 3 Drawing Sheets

COMPRESSOR HAVING A U-SHAPED DISCHARGE HOLE AND A U-SHAPED DISCHARGE VALVE

RELATED APPLICATIONS

This is a U.S. National Phase Application under 35 USC §371 of International Application PCT/JP2009/060037 filed on Jun. 2, 2009.

This application claims the priority of Japanese Patent Application No. 2008-157525 filed Jun. 17, 2008, the entire content of which is hereby incorporated by reference.

TECHNICAL FIELD OF THE INVENTION

The present invention relates to a compressor, and specifically relates to a compressor with improved structures of a discharge hole and a discharge valve.

BACKGROUND ART OF THE INVENTION

A compressor, such as a piston-reciprocation type multi-cylinder compressor for compressing refrigerant used in an automotive air conditioning system, often has such a configuration where a valve plate, on which a suction hole capable of communicating between a suction chamber and a cylinder bore and a discharge hole capable of communicating between a discharge chamber and a cylinder bore are formed, is interposed between a cylinder head having the suction chamber and the discharge chamber and a cylinder block having cylinder bores, and a discharge valve consisting of a reed valve for opening/closing the discharge hole is provided at the discharge hole of the valve plate, and the discharge hole is located at a tip side of the reed valve. The discharge hole is usually formed into a circle, and a reed valve constituting the discharge valve is formed into a shape blocking up the circular discharge hole. In such a compressor, particularly in a compressor where a discharge chamber is located at an outer side and a suction chamber is located at an inner side, a retainer-integrated gasket is generally used as a stopper regulating a lift of the discharge valve during opening the discharge valve.

However, because the amount of the lift of the discharge valve is regulated during discharge step, the area of the cross section of a flow path opened is kept comparatively small to generate the resistance of the flow path, so that accompanied over-compression might cause phenomena, such as (1) decrease of the refrigeration ability derived from the blow-by of refrigerant leaking to the side of the crank chamber or (2) increase of power consumption for driving the compressor, etc., so as to make the compressor efficiency worse.

As for such problems, Patent document 1 discloses a structure where a hole through which discharged gas can pass is formed on a valve spring which gives the discharge valve the elastic force in order to reduce flow loss of the discharged gas, however, its reduction effect of the flow resistance is not sufficient because the cross section cannot be increased so greatly.

PRIOR ART DOCUMENTS

Patent Documents

Patent document 1: JP2005-90495-A

SUMMARY OF THE INVENTION

Problems to be Solved by the Invention

Accordingly, an object of the present invention is to make a new structure of a discharge hole and a discharge valve section, where even when a retainer regulates a lift of the discharge valve, an area of cross section for flowing discharged gas can be greatly increased and resistance at a flow path can be reduced, so that a compressor efficiency can be greatly improved as suppressing over-compression.

Means for Solving the Problems

To achieve the above-described embodiment, a compressor according to the present invention is a compressor wherein a valve plate formed with a suction hole capable of communicating between a suction chamber and a cylinder bore and a discharge hole capable of communicating between a discharge chamber and the cylinder bore is interposed between a cylinder head formed with the suction chamber and the discharge chamber and a cylinder block formed with cylinder bores, a discharge valve formed as a reed valve for opening/closing the discharge hole is provided relative to the discharge hole on the valve plate, and the discharge hole is located at a tip side of the reed valve, characterized in that the discharge hole is formed as a U-shape having a bottom part positioned at a tip side of the reed valve, and the reed valve is formed as a U-shape extending in correspondence to the U-shape of the discharge hole.

In such a compressor according to the present invention, the discharge hole on the valve plate is formed into U-shape and the discharge valve made from the reed valve is formed into a shape corresponding to the U-shape, so that the area of the gas flow path can be extended greater than a conventional circular discharge hole and a discharge valve in a shape blocking it up when the discharge valve opens, thereby reducing the resistance at the flow path to suppress over-compression, so as to make great improvement of the compressor efficiency. Further, the U-shaped discharge hole easily makes it possible that the discharge hole width, which means the width of each part of the U-shaped discharge hole, is not larger than the diameter of a circular discharge hole, and thereby even if high pressure is applied to the discharge valve during compression excessive stress can be prevented from generation. Furthermore, the U-shaped discharge hole makes it possible that the discharge hole exists as extending in a wide area, so that the valve tip does not have to be enlarged because the existence position of the discharge hole does not concentrate near the tip of the reed valve.

In such a structure of the compressor according to the present invention, it is possible that the U-shaped discharge hole extends continuously over the entire length of the discharge hole in a direction extending along the U-shape of the discharge hole, and alternatively, it is possible that the U-shaped discharge hole extends discontinuously in a direction extending along the U-shape of the discharge hole. In the structure of the former case, the gas flow path can be secured as having comparatively larger area. In the structure of the latter case, strength of the part forming the discharge hole on the valve plate can be maintained highly enough even when the discharge hole is formed as being relatively long in the direction extending along the U-shape because the discontinuous part can be made by the valve plate itself.

It is preferable that, when widths of the discharge hole measured at positions of respective arm parts of the U-shape of the U-shaped discharge hole are referred to as “a” and “b”, and a distance between both arms of the U-shape of the U-shaped reed valve is referred to as "c", a relation of a=b=c is approximately satisfied. Such a configuration makes it possible that the area of the gas flow path is expanded when the discharge valve opens and that the gas discharged from the discharge hole flows uniformly.

It is preferable that, when a width of the discharge hole measured at a position of a bottom part of the U-shape of the U-shaped discharge hole is referred to as "d", and a pseudo whole length of the discharge hole defined by a distance between a bottom point of a bottom part of the U-shape of the U-shaped discharge hole and a tip of one of arm parts of the U-shape of the U-shaped discharge hole is referred to as "e", a relation of e≥2d is satisfied. Such a configuration makes it possible that the above-mentioned advantage can be obtained so that the discharge valve does not have excessive stress as reducing resistance at the flow path and that the effect of prevention from expansion of the valve tip is surely obtained.

It is possible that lengths of both arms of the U-shape of the U-shaped discharge hole are equal to each other. Alternatively, it is possible that lengths of both arms of the U-shape of the U-shaped discharge hole are different from each other. In the latter configuration, the discharge hole is formed into J-shape to be more exact. In the present invention, the U-shaped discharge hole includes such a J-shaped discharge hole. Even in a case of such a J-shaped discharge hole, it is sufficient that the reed valve is formed into U-shape which extends as corresponding to the J-shape of the discharge hole.

In addition, the present invention is preferably applied to a structure where a retainer for regulating a lift of the reed valve is provided. As described above, the cross-sectional area of the flow path aperture tends to be reduced when the discharge valve has opened, by existence of the retainer which regulates the lift of the reed valve. Even if such a retainer exists the cross-sectional area of the gas flow path can be expanded from a conventional structure when the discharge valve has opened, by forming the discharge valve made by the reed valve into a shape corresponding to the U-shaped discharge hole, and thereby the resistance of the flow path can be reduced as suppressing over-compression, so as to improve the compressor efficiency.

The present invention is specifically suitable to a case where the retainer is formed as a gasket integrated retainer formed integrally with a gasket interposed between the valve plate and the cylinder head. Such a gasket can easily form a retainer of which structure is made along the technical idea of the present invention.

It is possible that a communication hole through which discharge gas can pass is formed in the retainer and/or a gasket. When such a communication hole is formed, the discharged gas can pass therethrough more smoothly and more easily, so that the resistance of the flow path can be reduced further.

It is also possible that the retainer is formed in a shape capable of engaging with a tip of the reed valve at a condition where the reed valve opens. Thus, especially by locking the tip of the reed valve, a desirable locking part, which means a retainer structure having a desirable stopper function for the discharge valve, can be constituted by a structure which has comparatively low strength without high rigidity.

It is preferable that, when an area of the discharge hole is referred to as S1, and an aperture area of a clearance between the discharge valve and the valve plate, as viewed from one side of the discharge valve at a condition where the discharge valve formed as the reed valve opens, is referred to as S2, a relation of S1<2×S2 is satisfied. In other words, because the area S2 of flow path for flowing the discharged gas in a gap between the discharge valve and the valve plate when the valve opens, can be expressed as an area size which is not smaller than almost a half of S1, the area S1 of the discharge hole is smaller than 2×S2, so that the gas discharged through the discharge hole can flow into the discharge chamber from the inside of the cylinder bores smoothly without great resistance, as contributing to the efficiency improvement.

It is preferable in the present invention, that the compressor is configured so that at least 3 main fluid routes are formed as viewed in a cross-sectional direction of the discharge valve at a condition where the discharge valve opens. In other words, such a configuration can be such that the discharge gas which has been discharged through both arms of the U-shape of the U-shaped discharge hole is bifurcated into both sides of each arm of the U-shape of the U-shaped discharge hole. In this case even if the flows which have been bifurcated at each arm position join together, three major passage routes are formed in total.

Further, the above-described U-shape in this invention includes extended shape conceptually. For example, the present invention includes a configuration where at least one of the discharge hole and the discharge valve formed as the reed valve is formed as one shape selected from the group consisting of a W-shape, an S-shape and an X-shape which are formed by connecting two U-shapes. In other words, parallel connection of two U-shapes makes a pseudo W-shape, and alternatively, parallel connection of two U-shapes of which either is reversed makes a pseudo S-shape. Further alternatively, parallel connection of two U-shapes of which either is reversed and of which tops are connected to each other makes a pseudo X-shape. As well as these W-shape, S-shape and X-shape, other shapes made by connecting two U-shapes to each other are possible.

Effect According to the Invention

Thus in the present invention, the U-shaped discharge hole and the discharge valve having a shape corresponding thereto makes it possible that the area of the discharged gas flow path is expanded, so that the resistance at the flow path is reduced so as to greatly improve the compressor efficiency. Even when the lift amount of the discharge valve is regulated by the retainer the resistance of the flow path can be reduced, so as to greatly improve the compressor efficiency by preventing over-compression.

EMBODIMENTS FOR CARRYING OUT THE INVENTION

Hereinafter, desirable embodiments of the present invention will be explained as referring to figures.

Figure 1:
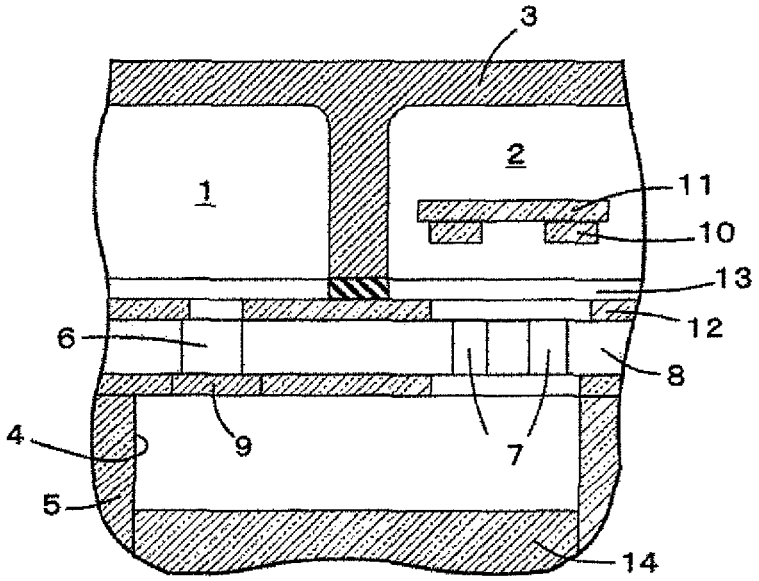
FIG. 1 is a partial longitudinal cross-sectional view showing discharge holes and a discharge valve of a compressor according to an embodiment of the present invention.
Figure 2:
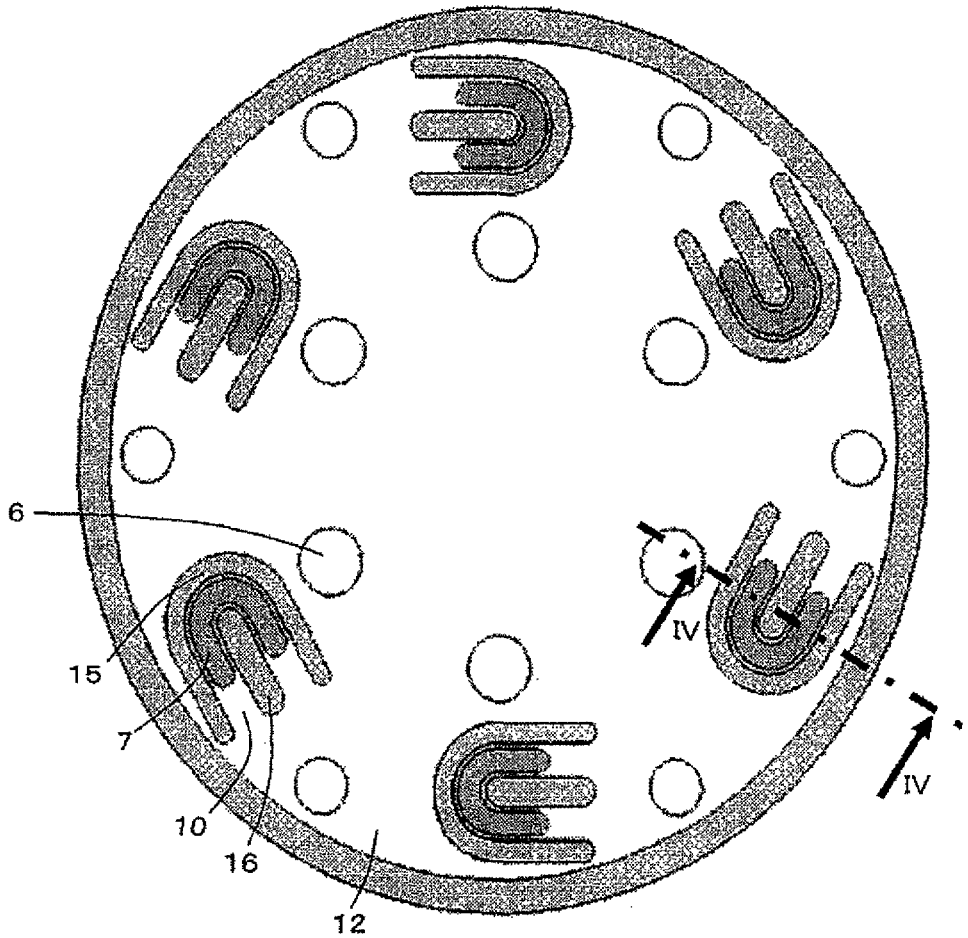
FIG. 2 is a transparent plan view showing a valve plate and discharge valve members of the compressor in FIG. 1, being seen from a cylinder head side.

FIGS. 1 to 6 depict a structure of a discharge hole and a discharge valve part in a compressor according to an embodiment of the present invention. In FIG. 1, valve plate 8, which is formed with suction holes 6 capable of communicating between suction chamber 1 and cylinder bores 4 and is formed with discharge holes 7 capable of communicating between discharge chamber 2 and cylinder bores 4, is interposed between cylinder head 3, which is formed with suction chamber 1 and discharge chamber 2, and cylinder block 5 formed with cylinder bores 4. Suction valve 9 formed as a reed valve for opening/closing a suction hole is provided relative to suction hole 6 on valve plate 8. Discharge valve 10 formed as a reed valve for opening/closing a discharge hole is provided relative to discharge hole 7, and discharge hole 7 is located at a tip side of the reed valve. Retainer 11 for regulating a lift of discharge valve 10, which functions as a stopper of discharge valve 10 when discharge valve 10 opens, is provided relative to discharge valve 10. As also shown in FIG. 2, discharge valves 10 are formed in disc-shaped discharge valve member 12, and a plurality of discharge valves 10 corresponding to the number of cylinders are arranged along a circumferential direction. In this embodiment, retainer 11 is formed into a gasket integrated retainer, which is formed integrally with gasket 13 interposed between valve plate 8 and cylinder head 3. In this embodiment shown in FIG. 2, as viewed in a radial direction of the compressor, suction holes 6 are located at the inner side of the radial direction and thus suction chamber 1 is located at the inner side of the radial direction. On the other hand, discharge holes 7 are located at the outer side of the radial direction and thus discharge chamber 2 is located at the outer side of the radial direction. Pistons 14 inserted in cylinder bores 4 are capable of reciprocating. Accompanying with the reciprocating movement, fluid to be compressed (for example, refrigerant gas) is sucked from suction chamber 1 to cylinder bore 4, and compressed fluid is discharged from cylinder bore 4 to discharge chamber 2.

As shown in the transparent view of FIG. 2, discharge hole 7 is formed into U-shape of which bottom side is positioned at a tip side of discharge valve 10 (reed valve). Further, discharge valve 10 made from a reed valve is formed into U-shape extending in correspondence with the U-shape of discharge hole 7. In order to form discharge valves 10 into the U-shapes, discharge valve member 12 is provided with U-shaped cut-out slots 15 outside discharge valves 10 and with straightly extending cut-out slots 16 inside discharge valves 10.

Figure 3:
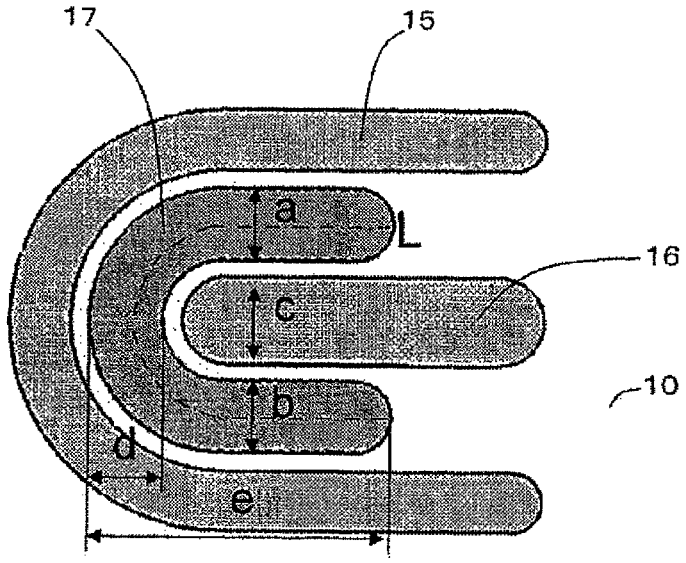
FIG. 3 is an enlarged transparent plan view showing a discharge hole and a discharge valve of the compressor in FIG. 1.

FIG. 3 depicts an enlarged transparent view of above-described discharge holes 7 and discharge valves 10, showing a size relationship of measurements in this part for this embodiment. As shown in FIG. 3, where the discharge hole widths measured at positions of respective arm parts of the U-shape of U-shaped discharge hole 7 are referred to as "a" and "b", and a gap between both arms of the U-shape of the U-shaped discharge valve 10 (reed valve) is referred to as "c", the relation "a=b=c" is approximately satisfied. Such a relation between measurements makes it possible that the gas discharged from discharge hole 7 flows uniformly while the area of the gas flow path is expanded when discharge valve 10 opens. Further, where discharge hole width measured at a position of a bottom part of the U-shape of U-shaped discharge hole 7 is referred to as "d", and a pseudo whole discharge hole length defined by a distance between a bottom point of a bottom part of the U-shape of U-shaped discharge hole 7 and a tip of one arm part (the longer one of the arm part: in the shown example both arm parts have the same length) of the U-shape is referred to as "e", the relation "e≥2d" is satisfied. Such a relation between measurements makes it possible that discharge valve 10 does not have excessive stress as reducing the resistance at the flow path. Besides, symbol "L" in FIG. 3 represents a whole length of discharge hole 7 along (tracing) the U-shape of discharge hole 7.

Figure 4:
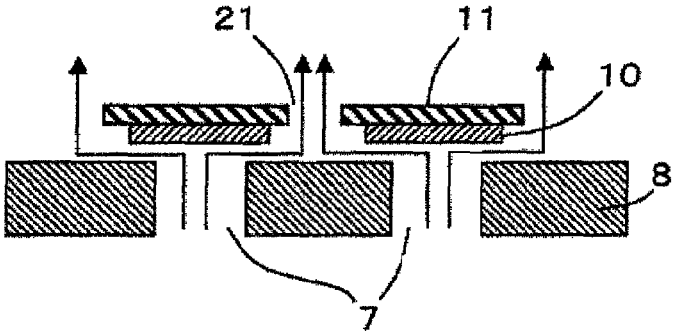
FIG. 4 is a schematic partial sectional view showing passage routes of discharged gas of the compressor in FIG. 1.

As shown in FIG. 4 which depicts the cross section including U-shaped discharge hole 7 and its corresponding U-shaped discharge valve 10 or which depicts the cross section viewed along IV-IV line in FIG. 2, when discharge valve 10 made from a reed valve opens, the lift amount of discharge valve 10 is regulated by retainer 11. At that time, as the gas flow represented by arrows is shown in FIG. 4, the discharged gas, which has passed through respective arm parts of the U-shape of U-shaped discharge hole 7, comes close to respective arm parts of the U-shape of opened discharge valve 10, and then the gas is bifurcated into left and right and is discharged into discharge chamber 2 through apertures at both sides. One and another flows of the gas, which have been bifurcated into either left or right at positions close to respective arm parts of the U-shape of discharge valve 10, are joined together, and the discharge gas is discharged into discharge chamber 2 through a gap between both arm parts of the U-shape of discharge valve 10 and through communication hole 21 which is formed in retainer 11 and through which the discharge gas can pass. Therefore in this embodiment, three major fluid passage routes are formed in total as viewed in a cross-sectional direction of the discharge valve.

Figure 5:
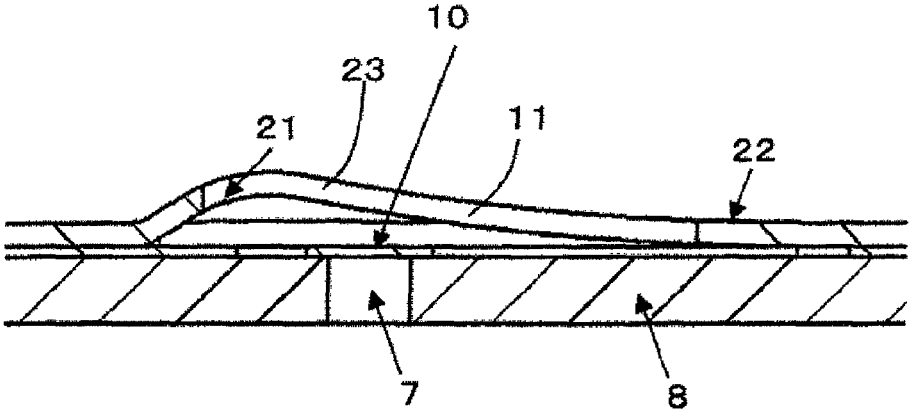
FIG. 5 is an enlarged partial longitudinal sectional view showing a retainer of the compressor in FIG. 1.

Further, in the condition where discharge valve 10 is opened, as explaining also referring to FIG. 5, where an area of discharge hole 7 (aperture area) is referred to as "S1", and where an aperture area of a clearance between discharge valve 10 and valve plate 8 (aperture area viewed in the same direction as FIG. 5), which is viewed from one side of discharge valve 10 when discharge valve 10 made from the reed valve opens, is referred to as "S2", the relation "S1<2×S2" is satisfied. Such a relation between aperture areas makes it possible that the gas discharged through discharge hole 7 flows into discharge chamber 2 from the inside of cylinder bores 4 smoothly without great resistance.

Figure 6:
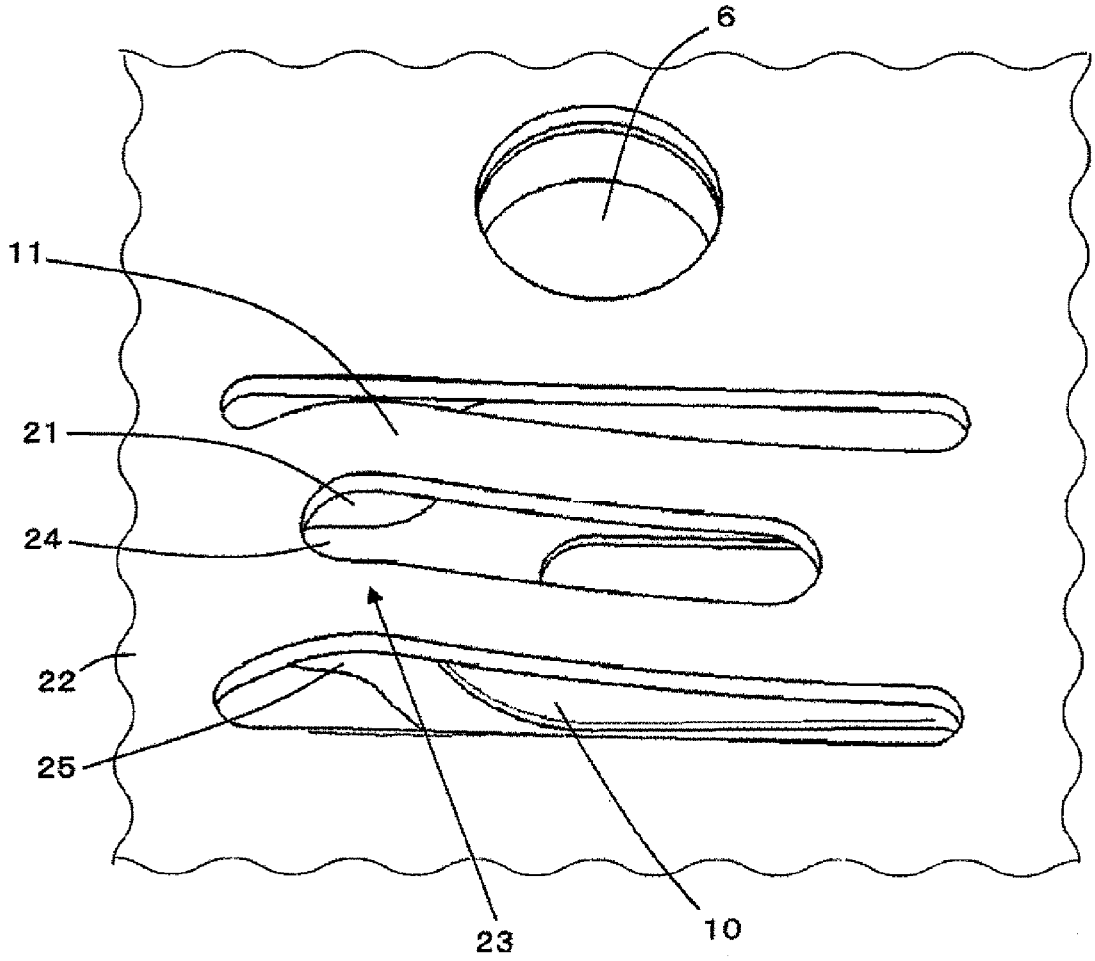
FIG. 6 is a transparent perspective view showing a part shown in FIG. 5 and therearound.

In this embodiment, as shown in FIG. 5, communication hole 21 is formed on the center portion of retainer 11 provided on retainer integrated gasket 22, and retainer 11, especially at a portion corresponding to a tip side of discharge valve 10, is formed into a shape capable of locking the tip of the valve in a condition where discharge valve 10 made from a reed valve opens. In other words, retainer 11 is formed as stopper 23 for stopping the tip of the valve. A diagrammatic perspective view of this portion is shown in FIG. 6. As shown in FIG. 6, communication hole 21 and stopper 23 are formed on retainer 11 which is formed by raising retainer integrated gasket 22. In the shown example, locking part 24, which is present at the tip of discharge valve 10 and can be locked with stopper 23, is formed as a valve extending portion at the tip of discharge valve 10. Symbol 25 in FIG. 6 indicates an aperture at a lateral side of valve 10 and of retainer 11 shown in FIG. 5.

Thus in the present invention, U-shaped discharge hole 7 and the discharge valve 10 having a shape corresponding thereto make it possible that the area of the discharged gas flow path is greatly expanded, so that the resistance at the flow path is greatly reduced so as to greatly improve the compressor efficiency. In addition, retainer 11 makes it possible that the resistance at the flow path is reduced greatly while maintaining a function to regulate the lift amount of discharge valve 10, so as to greatly improve the compressor efficiency by preventing over-compression.

INDUSTRIAL APPLICATIONS OF THE INVENTION

The structure of the compressor according to the present invention is applicable to any compressor with a valve plate which has a discharge hole and a discharge valve made from a reed valve. It is suitable for a refrigerant compressor, etc., for vehicles requiring improvement of efficiency.

Explanation of Symbols

1: suction chamber
2: discharge chamber
3: cylinder head
4: cylinder bore
5: cylinder block
6: suction hole
7: discharge hole
8: valve plate
9: suction valve
10: discharge valve
11: retainer
12: discharge valve member
13: gasket
14: piston
15, 16: cut-off slot
21: communication hole
22: retainer integrated gasket
23: stopper
24: locking part at tip of discharge valve
25: aperture

The invention claimed is:

1. A compressor comprising:

a cylinder head defining a suction chamber and a discharge chamber;

a cylinder block defining a cylinder bore;

a valve plate between the cylinder head and the cylinder block, the valve plate defining a suction hole for communication between the suction chamber and the cylinder bore, and a discharge hole for communication between the discharge chamber and the cylinder bore;

a discharge valve formed as a reed valve on the valve plate for opening/closing the discharge hole, the discharge hole being at a tip side of the reed valve, wherein the discharge hole has a U-shape having a bottom part positioned at the tip side of the reed valve and first parallel arm portions extending from the bottom portion, and the reed valve has a U-shape and second parallel arms corresponding to the U-shape and first parallel arms of the discharge hole to open and close the discharge hole.

2. The compressor according to claim 1, wherein the U-shaped discharge hole extends continuously over the entire length of the discharge hole.

3. The compressor according to claim 1, wherein the U-shaped discharge hole extends discontinuously over the length of the discharge hole.

4. The compressor according to claim 1, wherein, when widths of the first parallel arm portions of the discharge hole, respectively, are referred to as "a" and "b", and a distance between the first parallel arm portions is referred to as "c", then a=b=c, where the distance "c" is constant.

5. The compressor according to claim 1, wherein, when a width of the discharge hole measured at a position of the bottom part of the discharge hole is referred to as "d", and a pseudo whole length of the discharge hole defined by a distance between the bottom point of a bottom part of the discharge hole and a tip of one of the first parallel arm portion discharge hole is referred to as "e", then $e \geq 2d$.

6. The compressor according to claim 1, wherein lengths of both arms of the first parallel arm portion of the U-shaped discharge hole are equal to each other.

7. The compressor according to claim 1, wherein lengths of both arms of the first parallel arm portion of the U-shaped discharge hole are different from each other.

8. The compressor according to claim 1, further comprising a retainer for regulating a lift of the reed valve.

9. The compressor according to claim 8, wherein the retainer is formed integrally with a gasket interposed between the valve plate and the cylinder head.

10. The compressor according to claim 8, wherein the retainer and/or a gasket define a communication hole through which discharge gas can pass.

11. The compressor according to claim 8, wherein the retainer is configured to engage a tip of the reed valve when the reed valve is open.

12. The compressor according to claim 1, wherein, when an area of the discharge hole is referred to as S1, and an aperture area of a clearance between the discharge valve and the valve plate, as viewed from one side of the discharge valve when the discharge valve is open, is referred to as S2, then $S1 < 2 \times S2$.

13. The compressor according to claim 1, configured to define at least 3 main fluid routes as viewed in a cross-sectional direction of the discharge valve when the discharge valve is open.

14. The compressor according to claim 13, further comprising:

a retainer to engage the reed valve to regulate a lift of the reed valve when the reed valve is open, the retainer defining a communication hole through which discharge gas can pass, wherein, a first main fluid path extends past a first exterior side of a second parallel arms of the of the reed valve, a second main fluid path extends past a second exterior side of the second parallel arms of the reed valve opposite the first exterior side, and the third main fluid path extends between the second parallel arms of the reed valve, through the communication hole of the retainer, when the reed valve is in a completely open position engaging the retainer.

15. The compressor according to claim 1, wherein at least one of the discharge hole and the discharge valve has a shape selected from the group consisting of a W-shape, an S-shape and an X-shape formed by connecting two U-shapes.

* * * * *